US005641097A

United States Patent [19]

Renault et al.

[11] Patent Number: 5,641,097

[45] Date of Patent: Jun. 24, 1997

[54] MANUAL PRECOMPRESSION PUMP FOR THE SPRAYING OF A LIQUID AND A DISPENSING UNIT FITTED WITH SUCH A PUMP

[75] Inventors: Philippe Renault, Chaville, France; Adalberto Geier, Villazzono; Guiseppe Dalsant, Baselga di Pine, both of Italy

[73] Assignee: L'Oreal, Paris, France

[21] Appl. No.: 487,648

[22] Filed: Jun. 7, 1995

[30] Foreign Application Priority Data

Jun. 20, 1994 [FR] France ..... 94 07534

[51] Int. Cl.[6] ..... G01F 11/28

[52] U.S. Cl. ..... 222/321.2; 222/321.8; 239/333

[58] Field of Search ..... 222/321.2, 321.7, 222/321.8, 341, 383.1; 239/333, 373

[56] References Cited

U.S. PATENT DOCUMENTS

| | | | |
|---|---|---|---|
| 2,342,288 | 2/1944 | Mai | 299/97 |
| 3,061,202 | 10/1962 | Tyler | 222/341 X |
| 4,191,313 | 3/1980 | Blake et al. | 222/335 |
| 4,225,060 | 9/1980 | Kutik et al. | 222/189 |
| 4,678,122 | 7/1987 | Riglietti | 222/383.1 X |
| 5,092,495 | 3/1992 | Andre | 222/321.2 X |
| 5,192,006 | 3/1993 | Van Brocklin et al. | 222/321 |
| 5,193,748 | 3/1993 | Wittersheim et al. | 239/373 X |
| 5,518,377 | 5/1996 | Bougamont et al. | 222/341 X |

FOREIGN PATENT DOCUMENTS

| | | |
|---|---|---|
| 0 516 472 | 2/1992 | European Pat. Off. . |
| 2 634 825 | 2/1990 | France . |
| 1099695 | 1/1968 | United Kingdom . |

*Primary Examiner*—Joseph Kaufman

*Attorney, Agent, or Firm*—Oblon, Spivak, McClelland, Maier & Neustadt, P.C.

[57] ABSTRACT

A precompression pump for the spraying of a liquid includes a pumping chamber (2) containing a first piston (7) associated with a manipulating element (6), this piston bearing against a first spring (9). A precompression chamber (5) is provided with a second piston (10) bearing against a second spring (11), the precompression chamber communicating with the pumping chamber, their axes of symmetry being offset. A feeder duct (4) is provided with a valve (4a, 15) leading into the pumping chamber. A dispensing element (17) is provided with a nozzle (20) and with a dispensing duct (18) connecting the nozzle and the precompression chamber. The connection between the nozzle and the precompression chamber is interrupted in the rest position of the pump and is established under the action of the manipulating element.

20 Claims, 6 Drawing Sheets

FIG. 1a
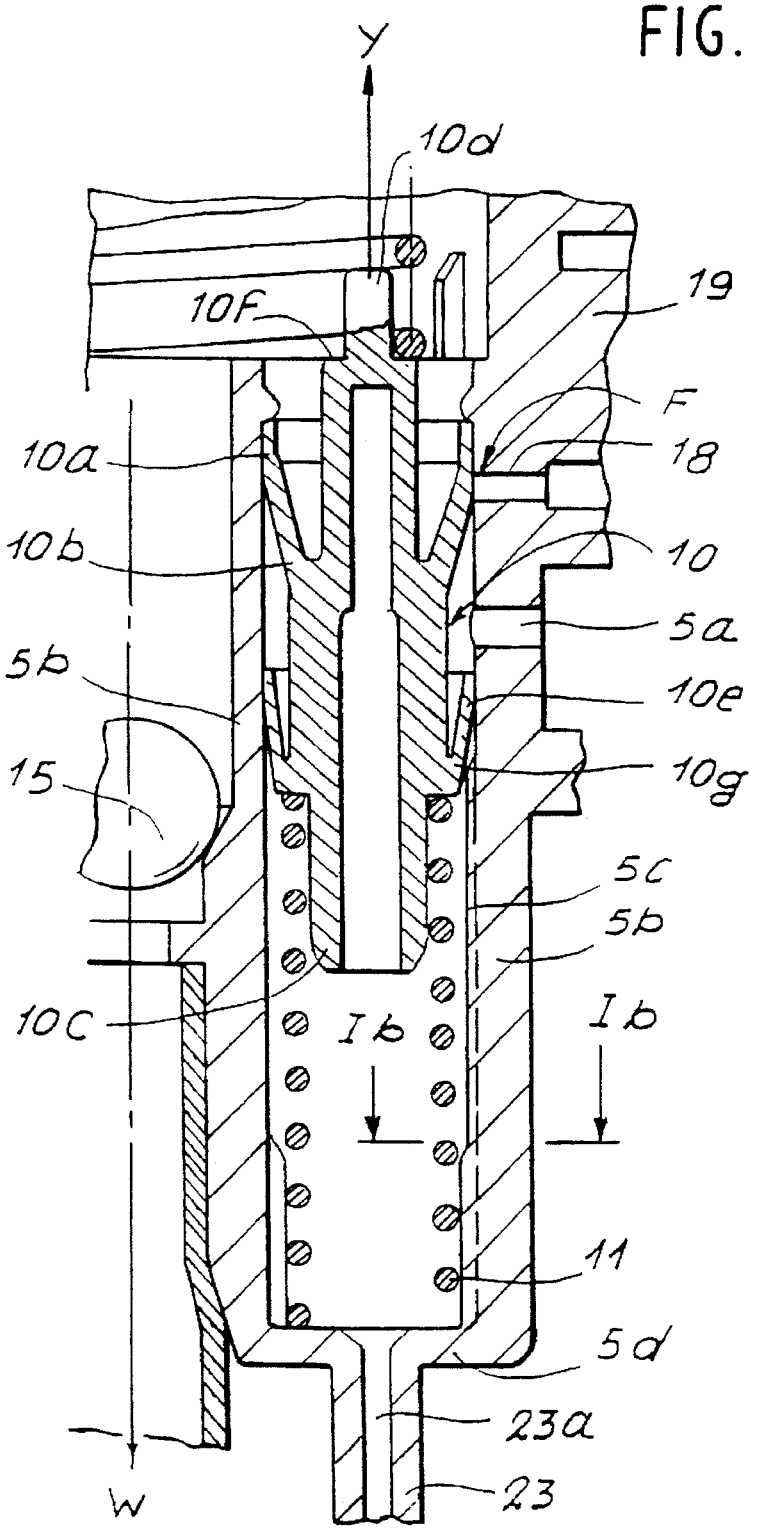
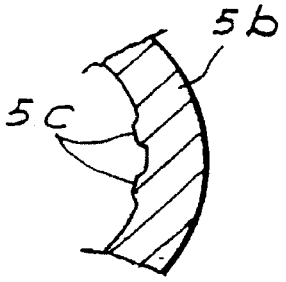
FIG. 1b

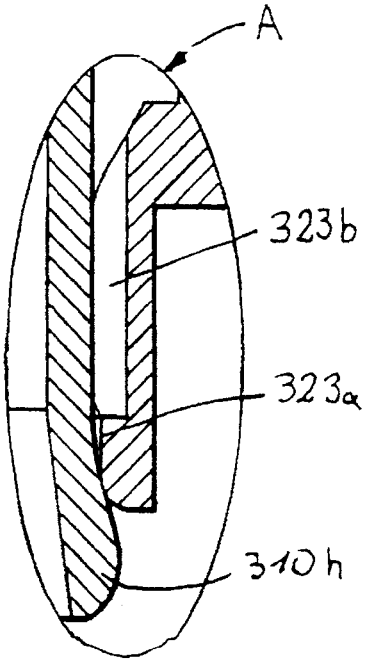
FIG.4b
FIG.4
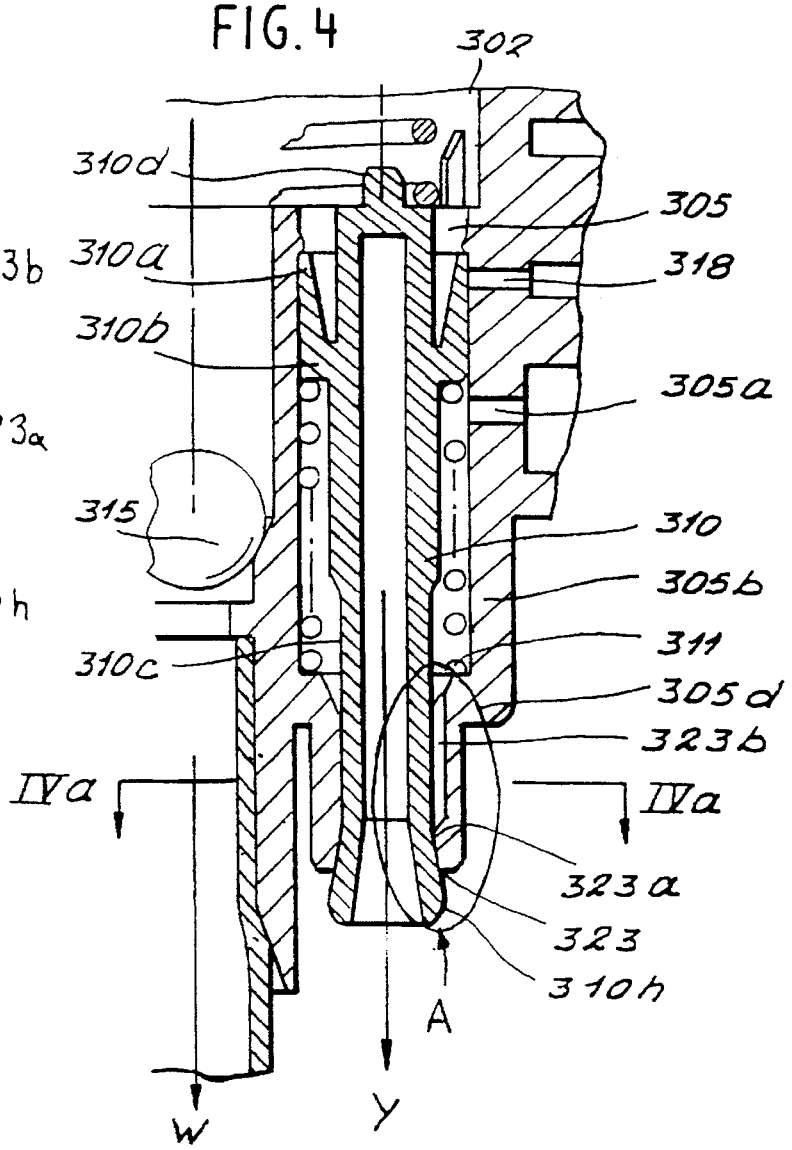
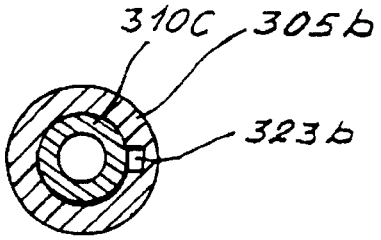
FIG. 4a

MANUAL PRECOMPRESSION PUMP FOR THE SPRAYING OF A LIQUID AND A DISPENSING UNIT FITTED WITH SUCH A PUMP

BACKGROUND OF THE INVENTION

1. Field of the Invention

The invention relates to a precompression pump for the spraying under pressure of a liquid, and in particular, of a cosmetic product such as a hair lacquer. The invention aims, in particular, to provide a pump of this kind that is operable by hand and of a small size, so that it can be accommodated in the cover cap of a dispenser for liquids.

2. Description of the Related Art

It is known that the precompression of a liquid contained in the body of a pump can ensure a good spraying quality irrespective of the mode of actuating the pump, and one therefore tries to obtain adequate precompression. Moreover, to maximize precompression efficiency, it is necessary that the loss of pressure during the flow of the liquid from the pumping chamber to the spraying nozzle should be as low as possible.

From Applicant's EP-A 0 437 131 there is known a manual precompression pump comprising, inter alia, a chamber for pumping the liquid that is in communication with a precompression chamber, a spraying nozzle connected by a dispensing duct to the precompression chamber, and a feeder duct provided with a non-return valve leading into the pumping chamber.

The precompression pump of the kind described in the EP-A 0 437 131 has low spraying accuracy because the actuation of this pump is effected by pressing on a push button which includes the spraying nozzle. As a result, it is difficult to target the spot where the spray is to be applied.

Moreover, because of its design, this known pump is difficult to assemble. Indeed, since all the parts making up this pump are aligned on the same axis of symmetry, its size in the axial direction is relatively large, which prohibits its use in many applications using a cover cap.

FR-A-2 634 825 discloses a precompression pump for the pressurized spraying of a liquid. There, a cylindrical body defines a cylindrical pumping chamber. A first piston, or actuating piston, associated with a manipulating element is accommodated in the pumping chamber, this piston bearing against a first resilient restoring means disposed in this chamber. A cylindrical precompression chamber communicating with the pumping chamber is provided with a second piston, or precompression piston, bearing against a second resilient restoring means. A feeder duct is provided with a non-return valve leading into the pumping chamber. A dispensing element is provided with a spraying nozzle and a dispensing duct connects the nozzle to the precompression chamber. The precompression chamber has a sliding means for providing the connection and closure of the dispensing duct, so that the connection is interrupted in the rest position of the pump. This connection is established at the end of the precompression under the action of the manipulating element. The sliding means for providing the connection and closure then frees a passageway between the precompression chamber and the dispensing duct.

This pump has the drawback of requiring a large number of components. Moreover, it is difficult to assemble in an industrial environment. The cost of such a pump is therefore relatively high. Moreover, the connection between the pumping chamber and the precompression chamber is constituted by a relatively long duct having several angles. Because of this, a loss of pressure occurs in the liquid during its dispensing, resulting in a spray of poor quality. Furthermore, the need for a one-way valve in this duct increases the pressure loss still further, thus requiring a considerable force on the user's part for actuating this pump. Finally, this pump has a large bulk, so that its use cannot be envisaged for all the requirements, in particular for the dispensing of liquids contained in containers with a small capacity.

SUMMARY OF THE INVENTION

It is an object of the present invention to remedy the drawbacks of the prior art by providing a unit for the dispensing of a liquid of a simple design, whose dispensing head is fixed and which has a precompression pump of a small size and with a small number of parts, and which is, therefore, easy to assemble from an industrial point of view.

It is further an object of the present invention to remedy the drawbacks of the prior art by providing a unit for the dispensing of a liquid wherein the pressure loss is minimized as compared with the pumps in accordance with the EP-A 0 437 131 and the FR-A-2 634 825, so that the spraying quality is improved, resulting in a reduction in the granulometric size of the liquid emerging from the nozzle.

More precisely, the present invention provides a precompression pump for the spraying under constant pressure of a liquid, of the kind described in the FR-A-2 634 825, but not having any valve between the pumping chamber and the precompression chamber. The precompression chamber is in the extension of the pumping chamber and the liquid contained in the pumping chamber has direct access to the precompression chamber during the actuation of the manipulating means.

To facilitate the priming of the pump before its first use, provision may be made for a means for evacuating the air inside the pump body, disposed between the first and the second piston. Advantageously, this means is a central stud arranged on the upper surface of the second piston and turned towards the pumping chamber. This stud is capable of coming to bear against the first piston when the manipulating element is being actuated, that is to say, when the volume of the pumping chamber is at its minimum. During this actuation, a mechanical connection is established between the two pistons, the first pushing the second into a position, such that the compressed air in the pump body can escape through the dispensing duct.

According to another advantageous characteristic of the invention, the nozzle is fixed relative to the pump body. This spraying nozzle is provided with a spraying orifice orientated along an axis substantially orthogonal to the axis of symmetry which defines the precompression chamber.

Advantageously, the sliding means for providing the connection and closure of this pump is, according to a first embodiment, constituted by a first annular lip joined to the second piston. In the rest position of the pump, this lip thus closes the connection between the precompression chamber and the dispensing duct. During the actuation of the pump when the manipulating element is depressed against the first resilient restoring means, the pressure of the liquid situated inside the body of the pump will rise up to a predetermined value and produce this connection by pushing the compression element against the second resilient restoring means. It is obvious that the predetermined precompression value depends on the force exerted by this second resilient restoring means.

Moreover, provision may be made for a means for the setting to atmospheric pressure, constituted for example by an air intake opening pierced in the wall of the pump body, leading into the lower portion of the precompression chamber, that is to say, into the portion where the second resilient restoring means is disposed, so as to balance the pressure obtaining in the reservoir with the external pressure. Advantageously, when the pump is at rest, this setting to the atmospheric pressure is inoperative. For this purpose, a sealing means may be disposed between the air intake opening and the reservoir obturating this opening during the period of storage and capable of admitting air into the reservoir during the dispensing of a dose of liquid.

Advantageously, in order to facilitate this setting to atmospheric pressure, provision is made for an orifice between the precompression chamber and the reservoir. Preferably this central orifice is extended in a cylindrical extension traversed by a capillary duct.

The function of the capillary duct is to prevent the liquid of the reservoir from penetrating into the lower portion of the precompression chamber on the side of the second restoring means. This is all the more useful when the liquid to be dispensed is a composition that is liable to dry out or clog the precompression piston such as, for example, hair lacquer or paint.

According to a first variant of the embodiment, this sealing means may be a second annular lip carried by the precompression piston, which is disposed inside the precompression chamber. This second lip is placed at a level situated between the first lip and the reservoir.

According to an aspect of this first variant, the precompression chamber is provided with at least one longitudinal rib situated in a zone between the second sealing lip, when it is in its rest position, and a bottom which separates the precompression chamber from the reservoir. Thus during the actuation of the pump, the second sealing lip of the precompression piston is moved away from the internal side of the precompression chamber, and air coming from the air intake opening may penetrate via the opening between the bottom of the precompression chamber and the reservoir, so as to replace a volume equivalent to the dispensed liquid.

According to a second variant of the embodiment of the invention, the means for the setting to atmospheric pressure may be constituted by a duct carried by the precompression piston and extending the latter in the direction towards the reservoir, and traversing a connection cut in the bottom of the precompression chamber. Preferably the end of the duct emerging in the reservoir is provided with a flared cylindrical ring with a diameter greater than that of the connection. Under the thrust of the second restoring means on the precompression piston in the rest position, this ring is capable of closing the connection between the reservoir and the lower portion of the precompression chamber on the side of the second restoring means. During the actuation of the pump, the precompression piston will be displaced in the direction towards the reservoir and thus moves the ring away from the walls of the connection, so that a passageway is established between the air intake opening and the reservoir.

According to a second embodiment of the invention, the sliding means for providing the connection and closing of the pump may be constituted by a stud formed at one end of the second piston which is opposite the first piston. This stud is capable of obturating an extension of the dispensing duct that is parallel to the axis defining the precompression chamber.

Advantageously, the first resilient restoring means accommodated in the pumping chamber is constituted by a helical spring, preferably made of metal. The second resilient restoring means is also constituted by a metallic helical spring. As has been explained above, by choosing an appropriate spring force, one may influence the force necessary for starting the dispensing of the liquid.

The non-return valve which prevents the liquid accumulated in the pumping chamber from descending again into the reservoir is preferably constituted by a spherical ball accommodated in a frustoconical portion of the feeder duct. This duct communicates by means of a dip tube with the liquid contained in a reservoir.

The pump can be used for the spraying of many liquids such as, for example, a cosmetic composition, in particular a hair lacquer, a body deodorant, a skin lotion or a pharmaceutical composition.

The invention also relates to a unit for dispensing a liquid in the form of droplets, comprising the reservoir for the liquid to be dispensed, surmounted by a precompression pump conforming to the characteristics which have been described above.

Provision may be made for a means for fixing the pump on the reservoir containing the liquid to be sprayed. This fixing means includes, for example, a disk-shaped element extending radially of the pump body and having a peripheral portion formed as a cylindrical skirt provided on its inside with a catch engagement bead capable of cooperating with a complementary annular groove made on a neck with which the reservoir is provided.

The reservoir may, moreover, have a cover cap fixed thereon, this cap surrounding the pump mounted on the reservoir.

According to a preferred embodiment of the present invention, the manipulating element is actuated by means of a lever arm articulated on one side of the cover cap. This arrangement allows the user to undertake the spraying of the liquid under good conditions in a precise manner, while exerting a force during the actuation which is smaller than that necessary for the pump of the prior art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1*a* is an enlarged view in an axial section of FIG. 1, showing the precompression chamber in the rest position of the pump;

FIG. 1*b* is a partial section along line 1*b*—1*b* of FIG. 1*a;*

FIG. 4 shows an enlarged section of a second variant of the first embodiment of the invention;

FIG. 4*a* is a section along line IVa—IVa of FIG. 4;

FIG. 4*b* is an enlarged view of the designated portion A of FIG. 4;

DESCRIPTION OF THE PREFERRED EMBODIMENTS

Figure 1:
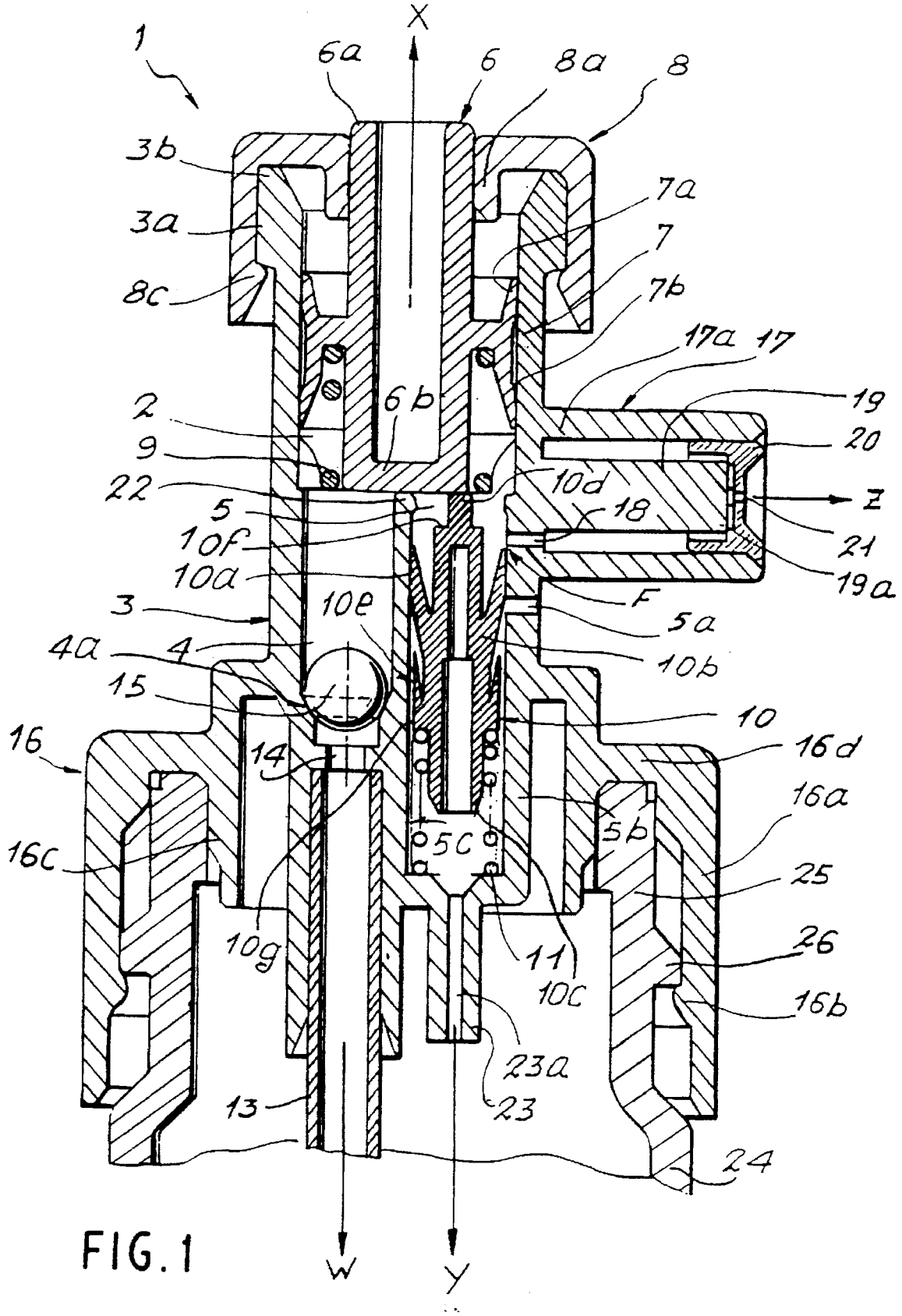
FIG. 1 is an axial section of a precompression pump in accordance with a first variant of a first embodiment of the invention, the pump being in the course of being actuated.

Referring to the drawings, in particular FIGS. 1 to 1*b*, a precompression pump 1 is mounted to a reservoir 24 for a liquid such as a hair lacquer. The reservoir 24 is surmounted by a cylindrical neck 25 that is provided with an external catch engagement bead 26.

The pump 1 has a generally cylindrical body 3 intended to be fixed on the neck 25 of the reservoir. The fixing is effected by a catch engagement ring 16 formed by a cylindrical skirt 16*a* carrying on its inside an annular rib 16*b* capable of cooperating with the bead 26 of the neck. The skirt 16*a* is joined to the circumference of a disk-shaped element 16*d*, itself extending radially from the pump body 3. This disk-shaped element 16*d* has, on the side turned towards the reservoir, a sealing skirt 16*c* fitted into the opening of the neck 25 of the reservoir 24.

At its end remote from the reservoir, the pump body 3 forms a cylindrical pumping chamber 2 having a central axis X of revolution, in which chamber there is accommodated a helical compression spring 9, generally metallic, which bears against a first piston 7. This piston 7 is joined to a cylindrical manipulating element 6 having an emerging end 6*a* serving to actuate the pump.

On the side facing the reservoir, the piston 7 has an extension 6*b* inserted inside the turns of the spring 9. The piston 7 has, moreover, two annular sealing lips applied against the internal wall of the body 3, of which a first, 7*a*, faces the emerging end 6*a*, while the second, 7*b*, faces the opposite direction.

The assembly formed by the piston 7 and the manipulating element 6 is held in position by a fixing cap 8 having an internal catch engagement bead 8*c*, this bead cooperating with an annular bulge 3*a* with which the free end 3*b* of the body 3 is provided. At its side opposite the reservoir, the cap 8 has a cylindrical skirt 8*a* serving to guide the sliding of the manipulating element 6.

A cylindrical extension 17 extends from a mid-portion of the pump body 3 along an axis Z that is substantially perpendicular to the central axis X, this extension forming a dispensing element. The dispensing element 17 has an annular bore 17*a* that communicates with a dispensing duct 18 which is parallel to the axis Z, this duct communicating with a precompression chamber 5 having an axis of revolution Y. The axis Y is parallel to the axis X and orthogonal to the axis Z.

The bore 17*a* surrounds a central stud 19, at the end 19*a* whereof is fixed a spraying nozzle 20 provided with a central orifice 21. The angle formed between the axes X and Z may vary from approximately 45° to approximately 135° according to the use envisaged.

On the side turned towards the reservoir, the pumping chamber 2 is extended as two cylindrical bores with a reduced diameter as compared with the diameter of the pumping chamber 2. The first bore forms a feeder duct 4 and the second bore forms the precompression chamber 5 which is delimited by a cylindrical wall 5*b*. Substantially above the level of the catch engagement ring 16, the dispensing duct 18 communicates with the precompression chamber 5.

In a zone situated between the duct 18 and the catch engagement ring, the wall 5*b* of the precompression chamber is provided with an air intake opening 5*a* whose function will be explained below during the description of the functioning of the pump. On its side turned towards the reservoir 24, the precompression chamber 5 terminates in a bottom 5*d* which is joined at right angles to the cylindrical wall 5*b* of the chamber 5. The bottom 5*d* has a cylindrical extension 23 traversed by a capillary duct 23*a*. Moreover, the cylindrical wall 5*b* is provided inside the chamber 5 with one or several longitudinal ribs whose function will be explained below.

The precompression chamber 5 has a precompression piston 10 of an elongate, generally cylindrical, shape capable of sliding in a leak-proof manner in this chamber and which is provided with two annular projections, a first 10*b* having a sealing lip 10*a*, and a second 10*g* provided with a sealing lip 10*e* situated at a level below that of the lip 10*a* relative to the reservoir 24. Moreover, the two lips each have a free edge which is directed in the same direction towards the pumping chamber 2. The lip 10*a* forms a sliding means F for providing the connection and closure, capable of obturating the dispensing duct 18 in the rest position and of establishing a connection in the position of dispensing the liquid between the chamber 5 and the duct 18. The lip 10*e* forms a sealing means between the outside and the reservoir.

The lower portion 10*c*, turned towards the reservoir, of the precompression piston 10 is engaged in the turns of a second helical spring 11 forming a second resilient restoring means, whose function is to urge the precompression element 10 in the rest position into a position wherein the sealing lip 10*a* is situated facing the dispensing duct 18 while closing the latter. In this closed position the lip 10*a* abuts against an annular bead 22 carried by the wall of the junction zone between the precompression chamber 5 and the pumping chamber 2. The spring 11 bears against the annular projection 10*g* carried by the precompression piston.

On the side turned towards the pumping chamber 2, the precompression element 10 forms a plate 10*f* which carries a central stud 10*d* extending in the pumping chamber 2 and whose function will be explained below.

The feeder duct 4 has an axis of symmetry W and is joined on its side opposite the pumping chamber 2 to a zone with a conical constriction 4*a* forming a passageway 14 receiving the liquid contained in the reservoir 24, via a dip tube 13.

The axis W is parallel to the axes X and Y and orthogonal to the axis Z. The axes W, X, Y and Z are situated in the same plane (that of FIG. 1).

In the constricted zone 4*a* of the feeder duct 4 there is accommodated a ball 15 having a diameter between that of the feeder duct and that of the constricted zone 4*a*. This ball 15 serves as valve for the admission of the liquid while preventing the liquid drawn into the pump body from redescending into the reservoir 24.

The precompression pump 1 in accordance with the invention functions as follows: at rest, the pump is in the position shown in FIG. 1, the body 3 containing air and the liquid being in the reservoir 24.

First, the user primes the pump, to fill the body 3 with liquid and expel the air, by pressing once or twice on the manipulating element 6. During this operation, the air contained in the body 3 is compressed. In the low position, the surface 6*b* of the manipulating element 6 comes to bear against the stud 10*d* of the second piston 10, which depresses the latter, thus freeing the passageway 18 through which the compressed air can escape.

When the user relaxes his pressure on the manipulating element 6, the spring 9 causes the piston 7 to rise. As a result, low pressure is created in the body 3, which opens the non-return valve, i.e., the ball 15, and raises a certain quantity of liquid into the body 3. When the body 3 is filled with liquid, further depression of the piston 7 produces a rapid rise in pressure in the body 3. Subsequently, the precompression element 10 is displaced, the lip 10*a* thus freeing the dispensing duct 18. This duct brings the liquid into the annular bore 17*a* which is in communication with the spraying orifice 21, where good quality atomization of the liquid is produced because of the short distance to be traversed in the dispensing duct 18.

As the dispensing of the liquid proceeds, low pressure is created in the reservoir 24. To allow the volume of the dispensed liquid to be replaced by air, the opening 5*a* leading to the outside can be caused to communicate with the reservoir 24 via the precompression chamber and the capillary duct 23*a*.

In the rest position which corresponds to the high position of the precompression piston 10, the precompression chamber 5 does not communicate with the dispensing duct 18 because of the presence of the lip 10*a*, and the air intake opening 5*a* does not communicate with the reservoir 24 because the lip 10*e* provides a seal. When the precompression piston 10 descends following the actuation of the manipulating element 6, the lip 10*e* slides into a zone wherein the ribs 5*c* are disposed. These ribs then cause the seal between the lip 10*e* and the internal wall of the chamber 5 to break, and the air coming from the opening 5*a* can penetrate into the reservoir 24, thus setting it to atmospheric pressure.

Figure 2:
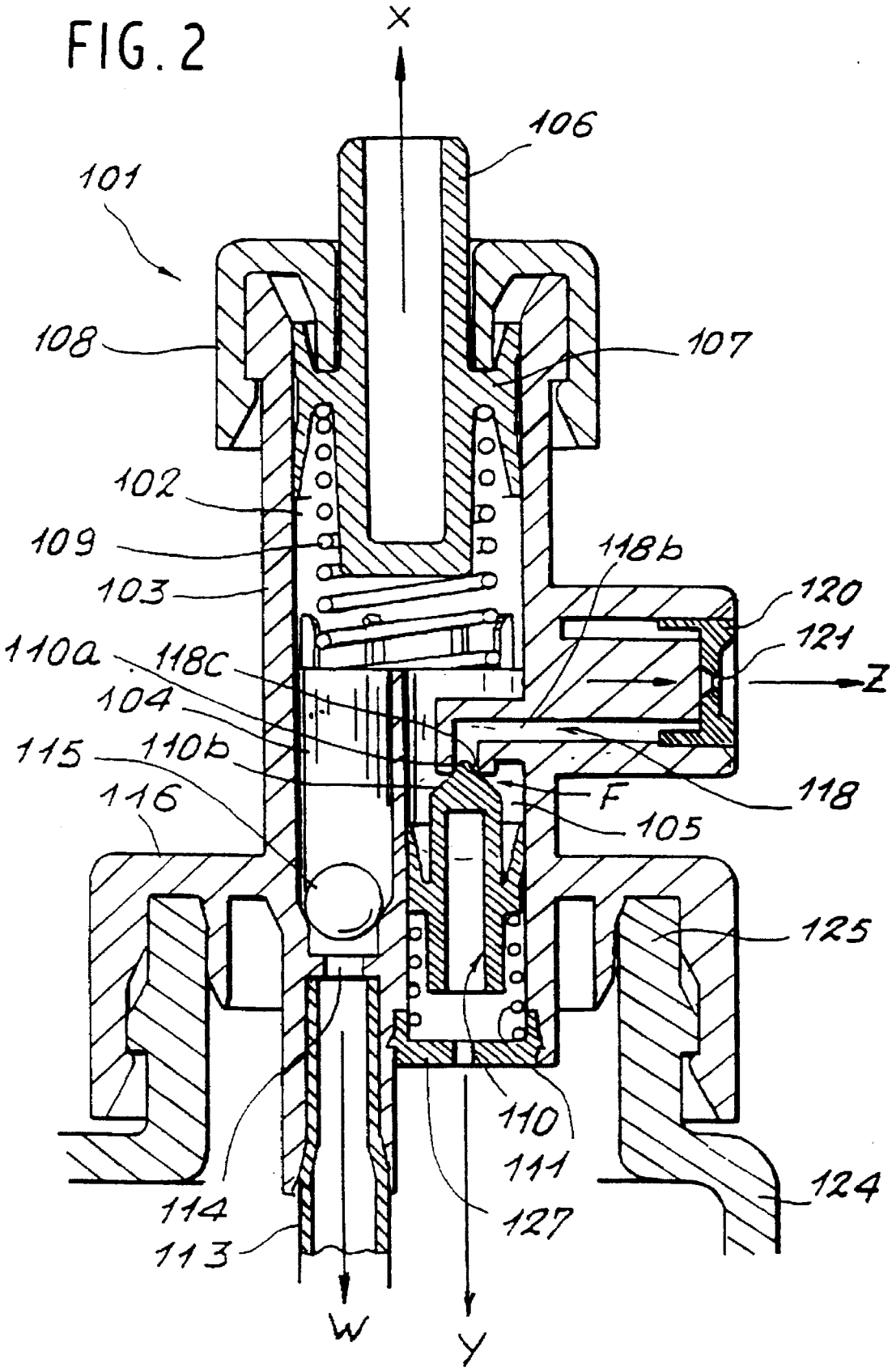
FIG. 2 is an axial section of a precompression pump according to a second embodiment of the invention.

Referring to FIG. 2, showing a second embodiment of a precompression pump in accordance with the invention, the component parts bear the reference numerals of the similar parts of FIG. 1, increased by 100. The description of the parts identical to those of FIG. 1 will not be repeated.

In the pump 101 according to FIG. 2 it is only the sliding means F for providing the connection and closure that is different, but performs a role identical to that described in FIG. 1. The pump body 103 does not have a means for the setting to atmospheric pressure, but it is possible to use a means similar to those described with reference to FIGS. 1, 4 and 5.

Thus the precompression element includes a piston 110 whose end 110*b* turned in the direction towards the pumping chamber 102 carries an obturating stud 110*a* which, in the rest position, closes an opening 118*c* formed in an elbow-shaped extension 118*b* of the dispensing duct 118. The piston 110 is mounted on a spring 111 which ensures, in the rest position, the closure of the connection and closure means F. The positioning of the spring 111 is provided by a cap 127 catch engaged on the bottom of the precompression chamber 105.

Figure 3:
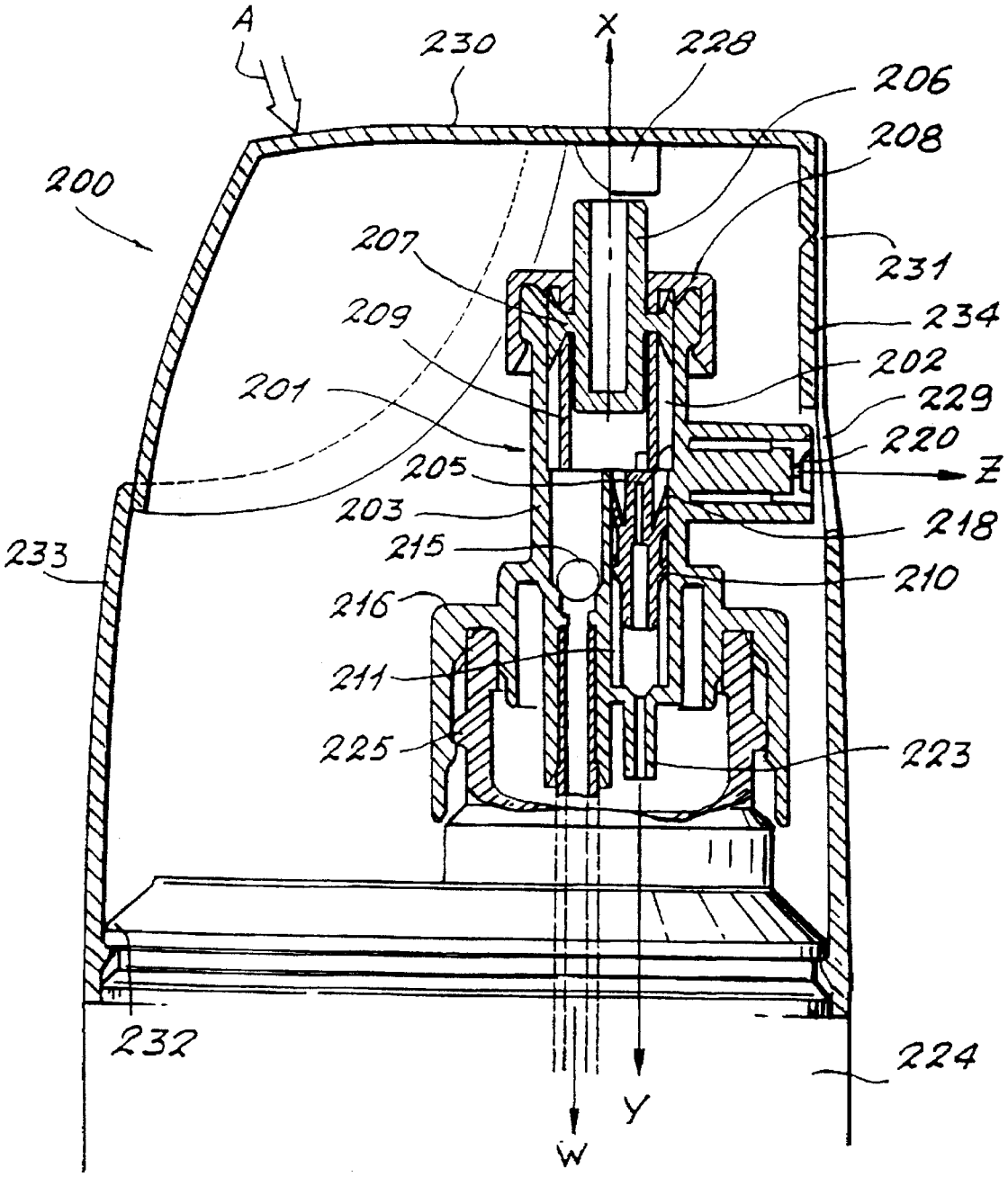
FIG. 3 shows a partial longitudinal section of a dispensing unit in accordance with the invention, fitted with a pump according to FIG. 1, in its rest position.

In FIG. 3, a partial section has been shown of a dispensing unit 200 in accordance with the invention, fitted with a precompression pump 201 in accordance with the embodiment of FIG. 1. The component parts of this unit that are the same as those of FIG. 1 bear the same reference numerals increased by 200. Thus, a precompression pump 201 is mounted by catch engagement on the neck of a reservoir 224. On a peripheral projection 232 of the reservoir, a cover cap 233 surrounding the pump 201 is fixed, for example by catch engagement.

This cover cap 233 has a front side 234 in which a hole 229 has been cut and through which the sprayed cone of liquid can pass during dispensing. The front side 234 of the cap 233 also has an elastic bending zone 231, for example a film hinge to which there is connected a lever arm 230. This lever arm is provided with a bearing zone 228 of a rounded shape and intended to cooperate with an element 206 for manipulating the pump 201.

The use of the unit 200 is as follows: when the user presses on the lever 230 in the direction of arrow A, the depression of the latter moves the manipulating element 206 and the piston 210 in the direction towards the reservoir 224. The access to the dispensing duct 218 is then freed and good quality spraying can be effected with a minimum of force on the user's part.

In FIGS. 4, 4*a* and 4*b*, an enlarged part section is shown of a precompression chamber 305 fitted with a precompression piston 310 according to a second variant of the embodiment of the invention. The component parts of this embodiment when identical with those of FIG. 1, or performing a similar function, bear the same reference numerals increased by 300.

According to this second variant of the embodiment, the means for the setting to atmospheric pressure is constituted by an extension 310*c* carried by the precompression piston 310 and extending the latter in the direction towards the reservoir; this extension traverses a cylindrical passageway (or connection) 323*a* cut in the bottom 305*d* of the precompression chamber 305. The extension 310*c* has a diameter smaller than the precompression piston 310, thus defining an annular space to permit an intake of air. The diameter of this extension is also smaller than that of the cylindrical passageway 323*a*.

The end of the extension emerging into the reservoir is provided with a flared cylindrical ring 310*h* with a larger diameter than that of the cylindrical passageway 323*a*. The free end of the passageway 323*a* has an opening 323 complementary to the ring 310*h* and capable of cooperating with the latter. These two parts form a valve; under the thrust of the second spring 311 on the precompression piston in the rest position, this ring closes the connection between the reservoir and the precompression chamber 305.

During the actuation of the pump, the precompression piston 310 is displaced in the direction towards the reservoir and thus moves the ring 310*h* away from the cylindrical passageway 323*a*, so that a connection is established between the air intake opening 305*a* and the reservoir. To facilitate the passing of air into the connection 323*a*, a longitudinal cut 323*b* is provided in the wall of the connection 323. The operation of this device is similar to that described with reference to FIG. 1.

Figure 5:
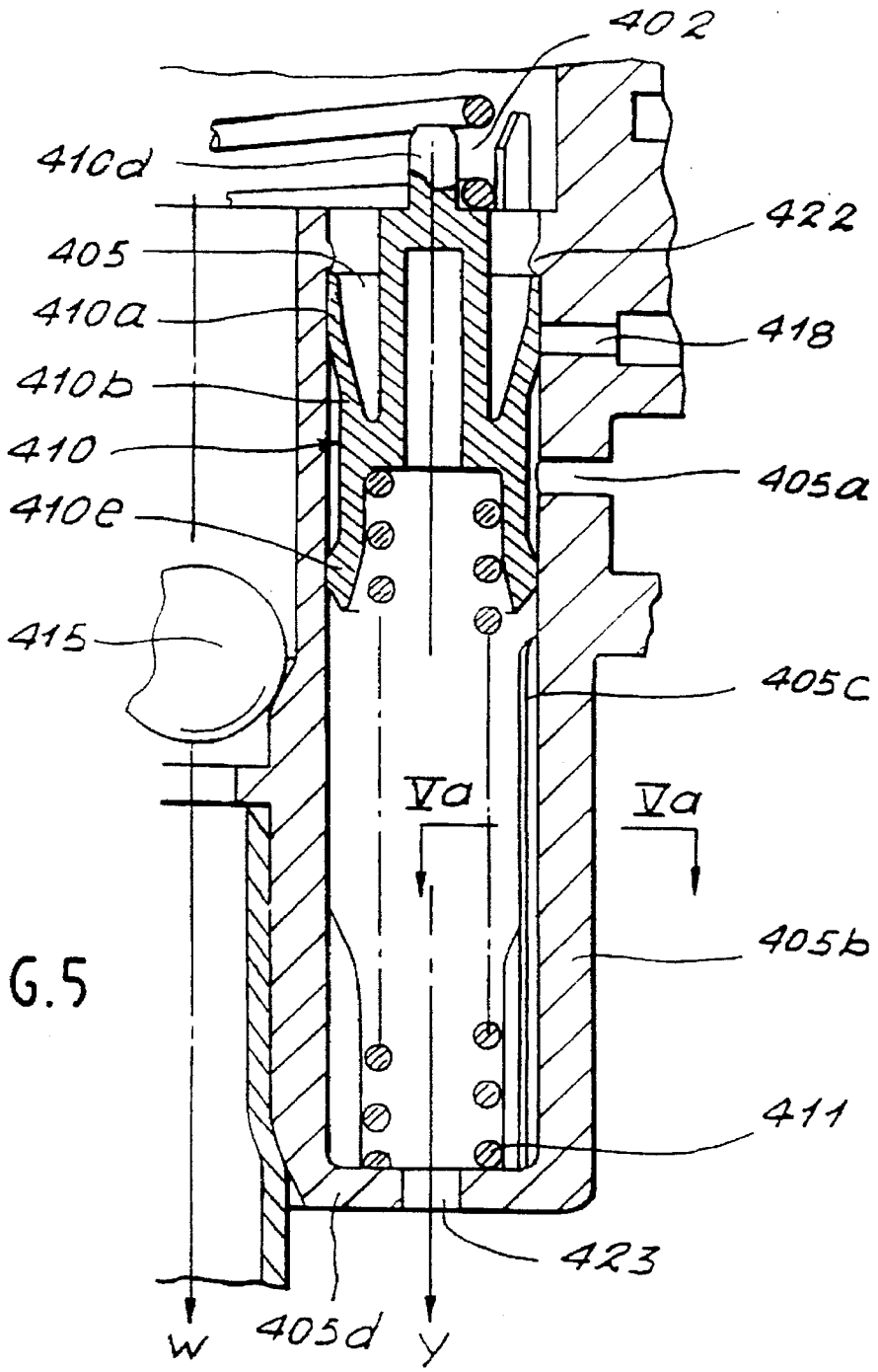
FIG. 5 shows an enlarged section of a third variant of the first embodiment of the invention.
Figure 5A:
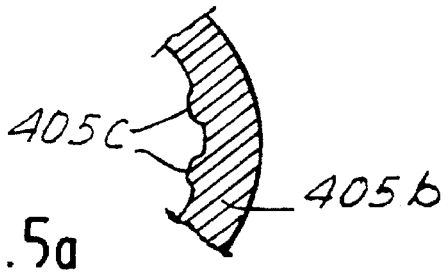
FIG. 5*a* is a section along line Va—Va of FIG. 5.

In FIGS. 5 and 5*a*, an enlarged partial section is shown of a precompression chamber 5 fitted with a precompression piston 410 according to a third variant of the embodiment of the invention. The component parts of this embodiment when identical with those of FIG. 1 or performing a similar function bear the same reference numerals increased by 400.

A precompression chamber 405 is delimited by a cylindrical wall 405*b* and a bottom 405*d*, itself provided with an opening 423. On the side turned towards the pumping chamber 402, there is disposed in this chamber 405 the precompression piston bearing against an annular bead 422 under the action of a restoring spring 411 provided between the piston 410 and the bottom 405*d*. The wall 405*b* has a dispensing duct 418 and an air intake opening 405 which leads to the outside. The precompression piston has two sealing lips; the first 410*a* extends towards the pumping chamber 402 and obturates the duct 418 in the rest position. The second lip 410*e*, facing the reservoir, stoppers the air intake opening 405*a* when the pump is at rest. In the zone between the bottom 405*d* and the second lip 410*e*, the chamber 405 is provided with one or more longitudinal ribs 405*c*.

This device functions in a way similar to that described with reference to FIG. 1.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A precompression pump for spraying a liquid under constant pressure, comprising:

a body defining a pumping chamber having an axis;

a first piston and a manipulating element in said pumping chamber, said manipulating element cooperating with said first piston to vary the size of said pumping chamber;

a first resilient restoring means disposed in said pumping chamber, said first piston bearing against said first resilient restoring means;

a precompression chamber forming an extension of said pump chamber in the direction of the axis thereof and having an axis;

a second piston and a second resilient restoring means in said precompression chamber, said second resilient restoring means maintaining said second piston in a rest position;

a feeder duct having a non-return valve and communicating said pumping chamber with a source of liquid to be pumped;

a dispensing element having a spraying nozzle;

a dispensing duct communicating said spraying nozzle with said precompression chamber; and sliding means in said precompression chamber and cooperating with said second piston for selectively providing a connection between said dispensing duct and said precompression chamber, wherein the connection between said dispensing duct and said precompression chamber is interrupted in the rest position of said second piston and the connection between said dispensing duct and said precompression chamber is established upon precompression by the manipulating element, wherein the axis of the precompression chamber is offset relative to the axis of the pumping chamber and wherein said pumping chamber has direct access to the precompression chamber during the actuation of the manipulating means.

2. A precompression pump according to claim 1, wherein said nozzle is fixed relative to said body.

3. A precompression pump according to claim 1, wherein said nozzle includes a spraying orifice orientated along an axis orthogonal to the axis of said pumping chamber.

4. A precompression pump according to claim 1, wherein said sliding means comprises an annular lip on said second piston.

5. A precompression pump according to claim 1, wherein said dispensing duct has an extension parallel to the axis of said precompression chamber, and wherein said sliding means comprises a stud formed on said second piston and closing said extension of the dispensing duct when said second piston is in the rest position.

6. A precompression pump according to claim 1, wherein the axes of said pumping chamber, said precompression chamber and said nozzle are in a single plane.

7. A precompression pump according to claim 1, wherein said first resilient restoring means comprises a helical spring.

8. A precompression pump according to claim 1, wherein said second resilient restoring means comprises a helical spring.

9. A precompression pump according to claim 1, wherein said non-return valve comprises a spherical ball accommodated in a frustoconical portion of said feeder duct.

10. A precompression pump according to claim 1, including a capillary duct communicating said precompression chamber and a reservoir for the liquid to be pumped.

11. A precompression pump according to claim 1, including means for selectively venting said precompression chamber to atmospheric pressure.

12. A precompression pump according to claim 11, wherein said means for selectively venting to atmospheric pressure comprises an air intake opening in said precompression chamber, a connection between said precompression chamber and a reservoir for the liquid to be pumped, and sealing means on said second piston for sealing communication between said air intake opening and said connection between said precompression chamber and a reservoir when said second piston is in the rest position.

13. A precompression pump according to claim 12, wherein said sealing means comprises an annular lip in leak-proof contact with a wall of the precompression chamber when said second piston is in the rest position, including a rib in said wall at a position for moving said lip away from said wall during actuation of the pump.

14. A precompression pump according to claim 12, wherein said sealing means comprises a flared cylindrical ring carried by said second piston, said ring being in leak-proof contact with a wall of the precompression chamber only when said second piston is in the rest position.

15. A precompression pump according to claim 1, including means for priming the pump disposed between said first and second pistons.

16. A precompression pump according to claim 15, wherein said means for priming the pump comprises a central stud situated on an upper plate of said second piston, said stud being positioned to bear against said first piston when said first piston is at a minimum volume position of said pumping chamber.

17. A unit for dispensing a liquid in the form of droplets, comprising a reservoir for liquid to be dispensed and a precompression pump mounted to said reservoir, said precompression pump comprising:

a body defining a pumping chamber having an axis;

a first piston and a manipulating element in said pumping chamber, said manipulating element cooperating with said first piston to vary the size of said pumping chamber;

a first resilient restoring means disposed in said pumping chamber, said first piston bearing against said first resilient restoring means;

a precompression chamber forming an extension of said pump chamber in the direction of the axis thereof and having an axis;

a second piston and a second resilient restoring means in said precompression chamber, said second resilient restoring means maintaining said second piston in a rest position;

a feeder duct having a non-return valve and communicating said pumping chamber with said reservoir;

a dispensing element having a spraying nozzle;

a dispensing duct communicating said spraying nozzle with said precompression chamber; and sliding means in said precompression chamber and cooperating with said second piston for selectively providing a connection between said dispensing duct and said precompression chamber, wherein the connection between said dispensing duct and said precompression chamber is interrupted in the rest position of said second piston and the connection between said dispensing duct and said precompression chamber is established upon precompression by the manipulating element, wherein the axis of the precompression chamber is offset relative to the axis of the pumping chamber and wherein said pumping chamber has direct access to the precompression chamber during the actuation of the manipulating means.

18. A unit according to claim 17, including means for fixing the pump to the reservoir.

19. A unit according to claim 18, wherein said fixing means comprises a disk-shaped element extending radially from the pump body and having a peripheral portion formed as a cylindrical skirt provided with a catch engagement bead positioned for cooperating with a corresponding annular thread formed on a neck of the reservoir.

20. A unit according to claim 17, including a lever arm for actuating said manipulating element.

* * * * *